United States Patent [19]

Stahlecker et al.

[11] Patent Number: 4,662,168

[45] Date of Patent: May 5, 1987

[54] PNEUMATIC YARN CONTROL ARRANGEMENT FOR OPEN-END FRICTION SPINNING

[75] Inventors: Fritz Stahlecker, Josef-Neidhart-Strasse 18, 7347 Bad Ueberkingen; Hans Stahlecker, Haldenstrasse 20, 7334 Suessen, both of Fed. Rep. of Germany

[73] Assignees: Hans Stahlecker; Fritz Stahlecker, both of Fed. Rep. of Germany

[21] Appl. No.: 828,620

[22] Filed: Feb. 12, 1986

[30] Foreign Application Priority Data

Mar. 15, 1985 [DE] Fed. Rep. of Germany ..... 3509339

[51] Int. Cl.[4] ..... D01H 1/135; D01H 7/898

[52] U.S. Cl. ..... 57/401

[58] Field of Search ..... 57/400, 401, 408, 411, 57/415

[56] References Cited

U.S. PATENT DOCUMENTS 4,281,507 8/1981 Didek et al. ..... 57/401

4,483,136 11/1984 Stahlecker et al. ..... 57/401

*Primary Examiner*—Donald Watkins

*Attorney, Agent, or Firm*—Barnes & Thornburg

[57] ABSTRACT

The invention relates to an arrangement for open-end friction spinning having two adjacently arranged rollers driven in the same rotational direction and forming a wedge-shaped gap in which the yarn formation takes place. An air supply device is provided having at least one compressed air jet extending into the plane of the wedge-shaped gap and being directed upon the yarn for purposes of favorably influencing the contact force of the yarn against the rollers, and thereby the friction effect and/or the position of the yarn. In especially preferred embodiments, a plurality of compressed air jets are disposed to blow air against the yarn at positions downstream of the fiber feed in the yarn withdrawal direction. A suction device and a further compressed air jet are provided at the side of the wedge-shaped gap opposite the fiber feed opening in certain embodiments.

21 Claims, 2 Drawing Figures

PNEUMATIC YARN CONTROL ARRANGEMENT FOR OPEN-END FRICTION SPINNING

BACKGROUND AND SUMMARY OF THE INVENTION

The invention relates to an arrangement for open-end friction spinning devices of the type having two adjacently arranged friction rollers driven in the same rotational direction and forming a wedge-shaped gap serving as the yarn formation region. A fiber feed channel extends along a fiber dispersion zone into the area of the wedge-shaped gap and serves as the transport means for the fiber material which has previously been opened up into single fibers. A suction device is provided for producing a suction air stream directed into the wedge-shaped gap and serving to retain the fibers and the yarn being produced in the wedge-shaped gap. Also an air supply device is provided for producing a compressed air stream directed against the area of the wedge-shaped gap. Finally a yarn withdrawal device is provided for withdrawing the produced yarn in the longitudinal direction of the wedge-shaped gap.

With a known arrangement of the above-mentioned kind described in German Published Unexamined Application (DE-OS) No. 33 08 250 and the corresponding U.S. Pat. No. 4,483,136, an air inlet opening is arranged on the side adjacent the mouth of the fiber feed channel in the area of the friction roller which rotates out of the wedge-shaped gap, which air inlet opening produces an air inlet flow which is enhanced under certain conditions by the compressed air. This air inlet stream facilitates loosening of any fibers that were carried along by the cover surface of the roller rotating out of the wedge-shaped gap, and to return said fibers into the yarn formation region so that the same can be twisted into the forming yarn. The slot-shaped air inlet opening may extend with this kind of construction even beyond the so-called fiber dispersion zone along the mouth of the fiber feed channel, whereby the produced yarn is retained within the wedge-shaped gap. With this construction it is provided that the additional air stream is first directed towards the cover surface of the roller rotating out of the wedge-shaped gap, and then deflected.

It is an object of the present invention to provide for an arrangement of the above-mentioned kind in such a manner that the spinning conditions can be influenced by providing an additional air stream.

This object is achieved in accordance with the invention by providing that the air inlet device includes at least one compressed air jet or nozzle extending into the plane of the wedge-shaped gap and being directed upon the yarn, thereby influencing the contact force of the yarn against the rollers.

This arrangement first makes it possible to influence the contact of the yarn against the rollers and thereby also to influence the friction effect upon the produced yarn.

In a further development of the invention, it is provided that the mouth or opening of the compressed air jet is arranged in direct proximity to the yarn being produced within the wedge-shaped gap. This will allow positive adjustment of the effect of the compressed air jet or the compressed air jets without disturbing the surrounding areas.

In a further development of preferred embodiments of the invention, it is provided that at least one compressed air jet follows the dispersion zone in the yarn withdrawal direction and is arranged on the same side of the wedge-shaped gap as the fiber feed channel. It is thereby possible to increase the friction effect in the area essential for the twisting process, in which area the full fiber amount is supplied to the yarn. It is thereby attained that the twisting is introduced more securely into the yarn and unsteady motions of the yarn in its axial direction are avoided. In a further advantageous development of preferred embodiments of the invention, it is provided that a draw-off suction device is arranged on the side of the wedge-shaped gap opposite the compressed air jet for facilitating the withdrawal of the supplied air.

In a further development of preferred embodiments of the invention, it is provided that at least one compressed air nozzle or jet is arranged at the side of the wedge-shaped gap facing away from the fiber feed channel, which jet is directed toward the beginning portion of the produced yarn. It is thereby possible to influence the position of the yarn tip in which the yarn does not contain the full amount of fibers such that the yarn tip is not too far drawn into the wedge-shaped gap. Any relative movements of the yarn tip compared to the rest of the yarn and the occurrence of thinning portions or even yarn breaks are thereby avoided. The yarn tip is positioned essentially in line with the extension of the produced yarn within the wedge-shaped gap. It is then advantageous if the blowing direction of the compressed air jet arranged at the side of the wedge-shaped gap facing away from the fiber feed channel is inclined against the yarn withdrawal direction. One thereby influences the tensile stress in the produced yarn and furthermore the yarn strength.

In another development of the invention, it is provided that the compressed air jets are equipped with adjusting elements for adjusting same with different blow pressures and/or blow quantities. This enables one to measure the effects and especially to make any adjustment as different fiber material is spun at a given time. It is likewise advantageous for the same purpose if, according to a further development of preferred embodiments of the invention, the compressed air jets are disposed in such a manner that their distance to the yarn and/or their inclination to the yarn withdrawal direction and/or their distance to the mouth of the fiber feed channel are adjustable.

Further objects, features, and advantages of the present invention will become more apparent from the following description when taken with the accompanying drawings which show, for purposes of illustration only, an embodiment constructed in accordance with the present invention.

DETAILED DESCRIPTION OF THE DRAWINGS

Figure 1:
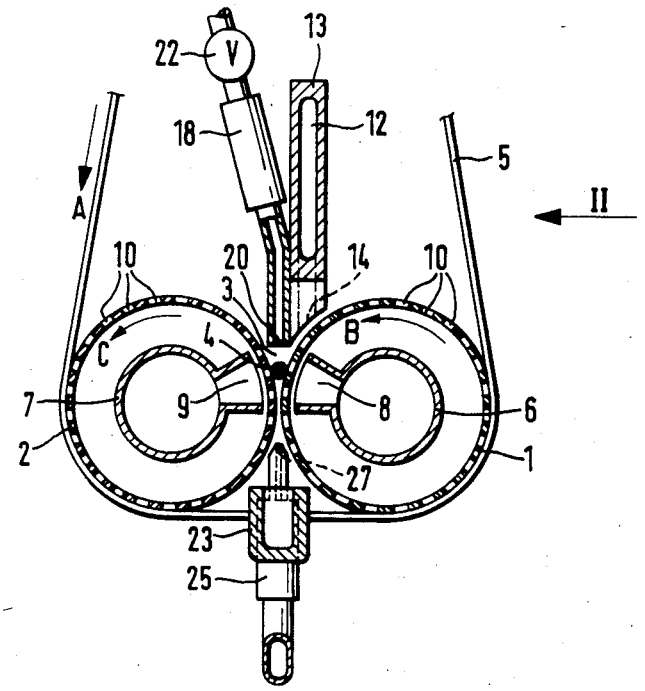
FIG. 1 is a partial schematic part-sectional view through a friction spinning unit constructed in accordance with a preferred embodiment of the invention.

The illustrated arrangement for open-end friction spinning includes two parallel adjacently arranged friction rollers 1 and 2 which together form a wedge-shaped gap 3 in which a yarn 4 is produced. The two rollers 1 and 2 are driven in arrow direction A by means of a drive belt 5 directly contacting cover surfaces of rollers 1 and 2. Belt 5 is driven by an electromotor not shown in detail. Rollers 1 and 2 are thereby driven in the same rotational direction in arrow direction B and C, respectively.

The rollers 1 and 2 are formed as cylindrical sleeves which are directly respectively borne upon pipes or tubes 6 and 7 arranged within their interior by means of not further illustrated bearings. The pipes 6 and 7, retained in a not further described manner, are designed as so-called suction pipes and are connected to a not further illustrated subpressure source. The two pipes 6 and 7 are Provided with suction slits 8 and 9 extending in the longitudinal direction of rollers 1 and 2 and facing the area of the wedge-shaped gap 3. The cover surfaces of rollers 1 and 2 respectively include perforations 10 facilitating a suction air stream in the area of the wedge-shaped gap 3 which flows through the cover surfaces of rollers 1 and 2 into the pipes 6 and 7.

Fiber material is supplied via a fiber feed channel 12 to the side of the wedge-shaped gap 3 serving as the yarn formation region. The fiber material was previously opened to single fibers by means of an opening device which is not shown here. The fibers are then transported into the fiber feed channel 12 by means of a transport air stream which has been produced essentially by means of the air stream obtained through the suction slits 8 and 9. The fiber feed channel 12, which is an integral part of a channel housing 13, includes an opening or mouth 14 positioned in the area of the wedge-shaped gap. The mouth 14 is formed slit-like and extends essentially parallel to the wedge-shaped gap 3. Mouth 14 is disposed a small distance from the wedge-shaped gap 3 and faces the cover surface of roller 1 rotating into said wedge-shaped gap 3. Another embodiment is contemplated which provides for the position of the mouth 14 of the fiber feed channel 12 to be directly in the plane of the wedge-shaped gap, which means in the plane extending through the wedge-shaped gap 3 transversely to the plane containing the two axes of rollers 1 and 2.

The supplied fibers are twisted within the wedge-shaped gap 3 based upon the friction effect produced by the two rollers 1 and 2, and are withdrawn as a yarn 4 in the direction of the extension of wedge-shaped gap 3 by means of a withdrawal device (arrow direction D) which is schematically depicted in the form of a withdrawal roller pair 11. The fiber feed channel 12 is inclined at an acute angle with respect to the yarn withdrawal direction D.

The mouth 14 of the fiber feed channel 12 forms a so-called dispersion zone within which the single fibers reach the area of the wedge-shaped gap 3. A so-called yarn tip 15 is Produced in the area of the dispersion zone and the yarn tip end 16 is disposed opposite the withdrawal direction D of the yarn 4. At the end of the mouth 14 located in the withdrawal direction D, the yarn 4 in the dispersion zone exhibits its final fiber count. Following in the direction D is the active twisting zone 17 in which the yarn experiences its substantial twisting based upon the friction effect of the two rollers 1 and 2.

In order to increase the frictional effect in the twisting zone 17, there are provided two compressed air jets 18 and 19 having slit-like mouths 20 and 21 positioned in the plane of the wedge-shaped gap (plane transverse to the axes of rollers 1 and 2) and pointed directly towards the yarn 4. The mouths 20 and 21 of the compressed air jets 18 and 19 are positioned one behind the other in the yarn withdrawal direction D. A sufficiently large distance is retained between the mouth 21 of the compressed air jet 19 and the mouth 14 of the fiber feed channel 12 so as to not disturb the transport air stream existing in the fiber feed channel 12. The compressed air jets 18 and 19 are adjustable via valves 22 so that the pressure and/or the quantity of air of the compressed air stream exiting from said jets and directed at the yarn 4 can be adjusted independently from each other. These compressed air streams increase the contact force between the yarn 4 and rollers 1 and 2 thereby strengthening the friction effect and furthermore obtaining a better twisting performance. In addition, it is avoided by means of these air streams that the yarn 4 performs "dolphin-like", swinging movements in the withdrawal direction D.

Figure 2:
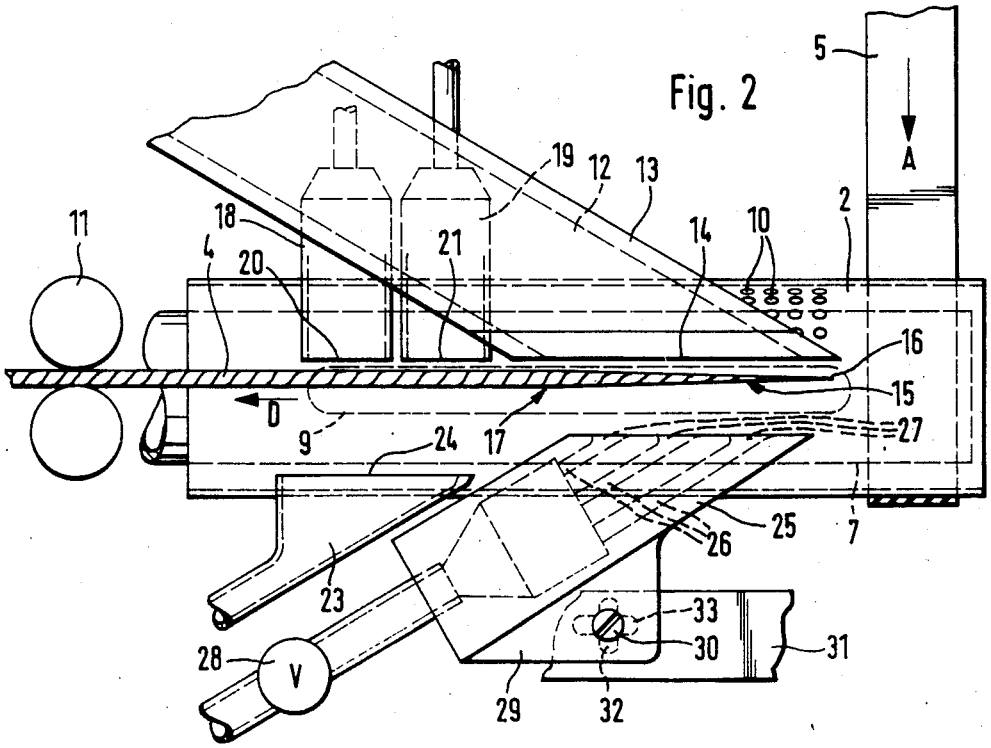
FIG. 2 is a schematic top view of the embodiment of FIG. 1, taken in the direction of Arrow II of FIG. 1 with roller 1 not shown so as to facilitate a better view of the yarn forming gap.

As can be seen from FIG. 2, the suction slits 8 and 9 (9 shown in FIG. 2) have such a length that the same also extend into the area of the compressed air jets 18 and 19. With the embodiment in accordance with FIG. 1, there is additionally provided a suction nozzle 23 on the side of the wedge-shaped gap 3 opposite the compressed air jets 18 and 19. The slit-like mouth 24 of this suction nozzle 23 is disposed opposite the mouths 20 and 21 of the compressed air jets 18 and 19. This facilitates the control of the compressed air stream in the plane of the wedge-shaped gap 3.

The full amount of fibers contained in the yarn 4 after leaving the dispersion zone is not present in the area of the yarn tip 15 and especially not in the area of the yarn tip end 16. Therefore, the danger exists that the yarn tip 15 and especially its end 16 is sucked into the wedge-shaped gap 3 deeper, so that the yarn 4 in the area of its yarn tip 15 is not extending aligned within the wedge-shaped gap 3. In order to facilitate a better straightening out of the yarn tip 15, a compressed air jet assembly 25 is arranged at the side of the wedge shaped gap 3 opposite the mouth 14 of the fiber feed channel 12, which jet assembly 25 is directed toward the yarn tip 15. The compressed air jet assembly 25 includes several channels 26 positioned one behind the other in the longitudinal direction of the wedge-shaped gap 3 which are each positioned opposite the yarn tip 15 with respective mouths or openings 27 which are opening up funnel-like. The compressed air jet assembly 25 is inclined in its entirety against the withdrawal direction D of yarn 4 thereby retaining the yarn tip 15 in a straight extended line. The compressed air jet assembly 25 is provided with a valve 28 which allows adjusting the blowing amounts and/or the blowing pressures. The effect of this compressed air jet 25 is metered or controlled in such a way that the existing transport air stream contained in the fiber feed channel 12 is not measurably disturbed. The compressed air streams from the compressed air jet assembly 25 can flow away towards the area of the drive belt 5.

The compressed air jet assembly 25 is provided with a latch or bracket attachment 29 by means of which the same is fastened to a stationary carrier 31 via a fastening screw 30. Elongated holes 32 and 33, which are offset in an angle of 90°, are provided in both the latch 29 and the carrier 31 so that not only the inclination of the compressed air jet assembly 25 is adjustable, but also the distance from the yarn 4, as well as also the position in the longitudinal direction of the wedge-shaped gap 3. Adjusting means are further provided according to other preferred embodiments, not shown, for the compressed air jets 18 and 19 which are assigned to the twisting zone 17.

By blowing air against the yarn 4 by means of the air stream produced by the compressed air jets 18, 19 and 25, the friction effect of rollers 1 and 2 exercised upon the yarn tip 15 and upon yarn 4 in the area of the twisting zone 17, is adjustable. By influencing the friction effect, one also influences the withdrawal stress of the yarn 4 which is thereby an indirect measure for the twisting operation. In a further embodiment which is not illustrated here, it is comtemplated to use an automatic maintenance device for measuring the yarn withdrawal tension for example in regularly occurring time intervals. This maintenance device is preferably arranged in such a manner that the same moves along an open-end friction spinning machine consisting of a plurality of adjacently arranged spinning stations or units of the described kind. If now the maintenance device determines that the yarn tension is not within the parameters of the predetermined range of tolerances at a spinning station, a readjustment is facilitated by means of the maintenance device itself via adjusting of the valves 22 and/or 28 and thereby adjusting of the effects of the compressed air jets 18, 19 and/or 25.

According to another embodiment contemplated by the invention, it is provided that each spinning device or station is equipped with its own tensioning sensor for determining the yarn withdrawal stress. This tensioning or stress sensor is connected to a signal transmitter which gives a corresponding signal upon the detected occurrence of a non-permissible change in the yarn withdrawal tension or stress, to a passing maintenance device thereby calling the same to the malfunctioning unit for attending to correct said malfunction without any interruption of the spinning process.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Apparatus for open-end friction spinning comprising:

friction rollers including a yarn forming wedge gap therebetween, fiber feed channel means for guiding fibers to the friction rollers, said fiber feed channel means including a fiber feed opening defining a fiber dispersion zone extending along the friction rollers, yarn withdrawal means for withdrawing formed yarn from the wedge gap, and air supply device means for producing a compressed air stream directed toward the area of the wedge gap, said air supply device means including compressed air jet nozzle means arranged on the side of the wedge gap facing oppositely of the fiber feed channel and directed toward the fiber dispersion zone for influencing the contact force of the yarn against the friction rollers.

2. Apparatus according to claim 1, including two friction rollers arranged adjacent one another to form the yarn forming wedge gap therebetween.

3. Apparatus according to claim 2, including transport air stream inducing means for inducing a flow of transport air to aid in the transport of the fibers via the feed channel means to the fiber dispersion zone.

4. Apparatus according to claim 3, wherein the compressed air jet nozzle means includes at least one compressed air jet nozzle disposed in direct proximity to the yarn being formed in the wedge gap.

5. Apparatus according to claim 3, wherein said compressed air jet nozzle means further includes at least one compressed air jet nozzle disposed in facing relationship to the wedge gap at the same side thereof as the fiber feed channel means and at a position downstream of the dispersion zone in the yarn withdrawal direction D.

6. Apparatus according to claim 4, wherein said compressed air jet nozzle means further includes at least one compressed air jet nozzle disposed in facing relationship to the wedge gap at the same side thereof as the fiber feed channel means and at a position downstream of the dispersion zone in the yarn withdrawal direction D.

7. Apparatus according to claim 3, wherein said compressed air jet nozzle means is directed toward the beginning portion of the yarn being produced.

8. Apparatus according to claim 7, wherein said compressed air jet nozzle means effects a compressed air flow in a direction inclined against the yarn withdrawal direction D.

9. Apparatus according to claim 3, further comprising adjusting element means for controlling different air flow pressures and/or flow quantities from the compressed air jet nozzle means.

10. Apparatus according to claim 5, further comprising a draw off suction device arranged at the side of the wedge gap opposite the compressed air jet nozzle means.

11. Apparatus according to claim 3, further comprising location adjustment means for adjusting the position of the compressed air jet nozzle means with respect to the location of the yarn and the fiber feed opening of the fiber feed channel.

12. Apparatus according to claim 3, wherein said compressed air jet nozzle means, includes a plurality of separate compressed air jet nozzles arranged one behind the other in longitudinal direction along the wedge gap.

13. Apparatus according to claim 3, further comprising compressed air jet nozzle means disposed at the same side of the wedge gap as the fiber feed opening and at a position downstream of the fiber dispersion zone for directing air against the yarn in the wedge gap which is being formed thereat.

14. Apparatus according to claim 13, wherein the compressed air jet nozzle means at the side of the fiber feed opening include a plurality of separate compressed air jet nozzles disposed one behind the other in the yarn withdrawal direction D.

15. Apparatus according to claim 14, further comprising a suction nozzle disposed at the side of the wedge gap opposite the fiber feed opening and at a position facing the area where the compressed jet air nozzles are acting on the yarn downstream of the dispersion zone.

16. Apparatus comprising:

two friction rollers arranged adjacent one another to form a yarn forming wedge gap therebetween, a wedge gap plane extending through the middle of the wedge gap transverse to a plane containing the axes of the two friction rollers, fiber feed channel means for guiding fibers to the friction rollers, said fiber feed channel means including a fiber feed opening defining a fiber dispersion zone extending along the friction rollers.

transport air stream inducing means for inducing a flow of transport air to aid in the transport of the fibers via the feed channel means to the fiber dispersion zone, yarn withdrawal means for withdrawing formed yarn from the wedge gap, and air supply device means for producing a compressed air stream directed toward the area of the wedge gap, said air supply device means including compressed air jet nozzle means extending into the wedge gap plane and directed toward the yarn for influencing the contact force of the yarn against the friction rollers, wherein said compressed air jet nozzle means includes at least one corpressed air jet nozzle disposed in facing relationship to the wedge gap at the same side thereof as the fiber feed channel means and at a position downstream of the dispersion zone in the yarn withdrawal direction D, and a draw off suction device arranged at the side of the wedge gap opposite the compressed air jet nozzle means.

17. Apparatus comprising:

two friction rollers arranged adjacent one another to form a yarn forming wedge gap therebetween, a wedge gap plane extending through the middle of the wedge gap transverse to a plane containing the axes of the two friction rollers, fiber feed channel means for guiding fibers to the friction rollers, said fiber feed channel means including a fiber feed opening defining a fiber dispersion zone extending along the friction rollers, transport air stream inducing means for inducing a flow of transport air to aid in the transport of the fibers via the feed channel means to the fiber dispersion zone, yarn withdrawal means for withdrawing formed yarn from the wedge gap, and air supply device means for producing a compressed air stream directed toward the area of the wedge gap, said air supply device means including compressed air jet nozzle means extending into the wedge gap plane and directed toward the yarn for influencing the contact force of the yarn against the friction rollers, wherein said compressed air jet nozzle means includes at least one compressed air jet nozzle disposed in facing relationship to the wedge gap at the same side thereof as the fiber feed channel means and at a position downstream of the dispersion zone in the yarn withdrawal direction D, and location adjustment means for adjusting the position of the compressed air jet nozzle means with respect to the location of the yarn and the fiber feed opening of the fiber feed channel.

18. Apparatus comprising:

two friction rollers arranged adjacent one another to form a yarn forming wedge gap therebetween, a wedge gap plane extending through the middle of the wedge gap transverse to a plane containing the axis of the two friction rollers, fiber feed channel means for guiding fibers to the friction rollers, said fiber feed channel means including a fiber feed opening defining a fiber dispersion zone extending along the friction rollers, transport air stream inducing means for inducing a flow of transport air to aid in the transport of the fibers via the feed channel means to the fiber dispersion zone, yarn withdrawal means for withdrawing formed yarn from the wedge gap, and air supply device means for producing a compressed air stream directed toward the area of the wedge gap, said air supply device means including compressed air jet nozzle means extending into the wedge gap plane and directed toward the yarn for influencing the contact force of the yarn against the friction rollers, wherein said compressed air jet nozzle means includes at least one compressed air jet nozzle disposed in facing relationship to the wedge gap at the same side thereof as the fiber feed channel means and at a position downstream of the dispersion zone in the yarn withdrawal direction D, and wherein said compressed air jet nozzle means, includes a plurality to separate compressed air jet nozzles arranged one behind the other in longitudinal direction along the wedge gap.

19. Apparatus comprising:

two friction rollers arranged adjacent one another to form a yarn forming wedge gap therebetween, a wedge gap plane extending through the middle of the wedge gap transverse to a plane containing the axes of the two friction rollers, fiber feed channel means for guiding fibers to the friction rollers, said fiber feed channel means including a fiber feed opening defining a fiber dispersion zone extending along the friction rollers, transport air stream inducing means for inducing a flow of transport air to aid in the transport of the fibers via the feed channel means to the fiber dispersion zone, yarn withdrawal means for withdrawing formed yarn from the wedge gap, and air supply device means for producing a compressed air stream directed toward the area of the wedge gap, said air supply device means including compressed air jet nozzle means extending into the wedge gap plane and directed toward the yarn for influencing the contact force of the yarn against the friction rollers, wherein said compressed air jet nozzle means includes at least one compressed air jet nozzle disposed in facing relationship to the wedge gap at the same side thereof as the fiber feed channel means and at a position downstream of the dispersion zone in the yarn withdrawal direction D, and wherein said compressed air jet nozzle means includes first jet nozzle means disposed at the side of the wedge gap opposite the fiber feed opening for directing compressed air into the dispersion zone where the yarn formation is initiated , and further comprising compressed air jet nozzle means disposed at the same side of the wedge gap as the fiber feed opening and at a position downstream of the fiber dispersion zone for directing air against the yarn in the wedge gap which is being formed thereat.

20. Apparatus according to claim 19, wherein the compressed jet air nozzle means at the side of the fiber feed opening include a plurality of separate compressed air jet nozzles disposed one behind the other in the yarn withdrawal direction D.

21. Apparatus according to claim 20, further comprising a suction nozzle disposed at the side of the wedge gap opposite the fiber feed opening and at a position facing the area where the compressed jet air nozzles are acting on the yarn downstream of the dispersion zone.

* * * * *